US012054232B2

(12) United States Patent
Tao et al.

(10) Patent No.: US 12,054,232 B2
(45) Date of Patent: Aug. 6, 2024

(54) ELECTRIC STEERING SYSTEM FOR SHIP PROPULSION APPARATUS AND METHOD THEREOF

(71) Applicant: Guangdong ePropulsion Technology Limited, Dongguan (CN)

(72) Inventors: Shi-Zheng Tao, Dongguan (CN); Yong Wang, Dongguan (CN); Xiao-Kang Wan, Dongguan (CN); Zong-Liang Pan, Dongguan (CN)

(73) Assignee: Guangdong ePropulsion Technology Limited, Dongguan (CN)

( * ) Notice: Subject to any disclaimer, the term of this patent is extended or adjusted under 35 U.S.C. 154(b) by 396 days.

(21) Appl. No.: 17/611,651

(22) PCT Filed: May 23, 2020

(86) PCT No.: PCT/CN2020/091963
§ 371 (c)(1),
(2) Date: Nov. 16, 2021

(87) PCT Pub. No.: WO2020/238814
PCT Pub. Date: Dec. 3, 2020

(65) Prior Publication Data

US 2022/0194538 A1 Jun. 23, 2022

(30) Foreign Application Priority Data

May 24, 2019 (CN) ..... 201910440848.9
May 24, 2019 (CN) ..... 201910440855.9
May 24, 2019 (CN) ..... 201910441928.6

(51) Int. Cl.
*B63H 20/12* (2006.01)
*B63H 25/02* (2006.01)

(52) U.S. Cl.
CPC ..... *B63H 20/12* (2013.01); *B63H 25/02* (2013.01); *B63H 2025/022* (2013.01)

(58) Field of Classification Search
CPC ... B63H 20/12; B63H 25/02; B63H 2025/022
See application file for complete search history.

(56) References Cited

U.S. PATENT DOCUMENTS 5,244,426 A * 9/1993 Miyashita ..... B63H 20/12 114/144 R
2012/0040572 A1 2/2012 Sachio et al.

FOREIGN PATENT DOCUMENTS

CN 101417702 A 4/2009
CN 102390508 A 3/2012
CN 206766310 U 12/2017
(Continued)

*Primary Examiner* — Stephen P Avila
(74) *Attorney, Agent, or Firm* — ScienBiziP, P.C.

(57) ABSTRACT

An electric steering system (1) including a steering device (40), an actuating device (30) and a related method for controlling the electric steering system. The steering device (40) is configured to transmit steering signals in response to user operations. The actuating device (30) is configured to control the electric motor (301) to rotate a link arm (202) according to the steering signal, bringing the rotatable assembly (203) to rotate along an axis of the ship propulsion apparatus (20), thereby adjusting an orientation of the propeller (2034). The actuating device (30) is rotatably coupled to an end of the link arm (202).

18 Claims, 10 Drawing Sheets

(56) References Cited

FOREIGN PATENT DOCUMENTS

| | | | |
|---|---|---|---|
| CN | 110155292 | A | 8/2019 |
| CN | 110155293 | A | 8/2019 |
| CN | 110155294 | A | 8/2019 |
| EP | 2607227 | A1 | 6/2013 |
| JP | 2006160214 | A | 6/2006 |

* cited by examiner

ELECTRIC STEERING SYSTEM FOR SHIP PROPULSION APPARATUS AND METHOD THEREOF

FIELD

The subject matter herein generally relates to marine steering system, disclosing an electric steering system of ship propulsion apparatus and a method thereof.

BACKGROUND

Ship propulsion apparatus can include an outboard motor, an inboard motor, or a pod drive. The steering system of a boat allows it to change direction. A boat can adjust an orientation of a propeller of the propulsion apparatus via the steering system, to adjust a driving direction of the boat. Alternatively, the boat may have a rudder in the water, to change the driving direction of the boat in that manner. The steering system usually includes a steering wheel and a steering actuating mechanism. The steering actuating mechanism can include a mechanical transmission manner and/or an electric control manner.

According to various types of the steering actuating mechanism, the steering system of the ship propulsion apparatus can include three kinds, respectively a mechanical cable steering system, a hydraulic steering system, and an electronic-hydraulic steering system.

The mechanical cable steering system converts a rotatable movement of the steering wheel to pulling a steering cable. The steering cable drives a L drag link arm to change orientations of the outboard motor. However, substantial force is needed to exert on the steering wheel during driving with the mechanical cable steering system. When the force is released from the wheel, the steering wheel may snap back quickly by the force coming from the rudder or propeller, and it's very dangerous at high speeds. For the mechanical cable steering system, it limits the minimum turning radius. Further, different lengths are customized for boats with different lengths, and greater turning force is needed as the boat moving at higher speed.

The hydraulic steering system provides a hydraulic oil circuit pressure to drive an oil cylinder in response to the steering wheel, accordingly to steer the outboard motor. However, an installing operation of the hydraulic steering system is complex, and hydraulic oil is needed to be injected into a pipeline of the hydraulic steering system. The hydraulic steering system has a higher failure rate at lower temperatures, has a risk of oil leakage, and a high maintain cost. A greater turning force is also required for high speed movement.

The electronic-hydraulic steering system is based on the hydraulic steering system, it responses to an electronic angle signal from the steering wheel. For the electronic-hydraulic steering system, it has good control accuracy and high-speed control performances. However, the system is complex and highly installation techniques is required, also it costs highest among the three kinds of the steering system. Moreover, the electronic-hydraulic steering system has the all shortcomings of the hydraulic steering system.

SUMMARY OF THE DISCLOSURE

The present disclosure provides an electric steering system of a ship propulsion apparatus and a method thereof. The electric steering system includes an actuating device and a steering device. The actuating device and the steering device have no direct mechanical connection. Thus, an installation position of the steering device is not limited. The whole electric steering system of the ship propulsion apparatus has advantages of a small size, a compact structure, and a quick and simple installation. The whole electric steering system can be compatible with various kinds of the ship propulsion apparatuses, and specially with the electric ship propulsion apparatus.

An embodiment of the present application provides an electric steering system. The electric steering system is applied on the ship propulsion apparatus. The ship propulsion apparatus includes a link arm and a rotatable assembly. The rotatable assembly includes a propeller. The steering device is configured to generate and transmit steering signals in response to user operations. The actuating device includes an electric motor. The actuating device is configured to control the electric motor to rotate the link arm according to the steering signal, bringing the rotatable assembly to rotate along an axis of the ship propulsion apparatus, accordingly adjusting an orientation of the propeller. The actuating device is rotatably connected to a first end of the link arm, and the rotatable assembly is rotatably connected to a second end of the link arm.

An embodiment of the present application provides a method for controlling an electric steering system. The method is applied on the electric steering system. The electric steering system is applied on the ship propulsion apparatus. The ship propulsion apparatus includes a link arm and a rotatable assembly. The rotatable assembly includes a propeller. The method for controlling the electric steering system includes providing a steering device configured to generate and transmit a steering signal in response to user operation and providing an actuating device including an electric motor and configured to control the electric motor to rotate the link arm according to the steering signal, bringing the rotatable assembly to rotate along an axis of the ship propulsion apparatus, accordingly adjusting an orientation of the propeller. The provided actuating device is rotatably connected to a first end of the provided link arm, and the provided rotatable assembly is rotatably connected to a second end of the provided link arm.

The present disclosure provides the electric steering system of the ship propulsion apparatus and the method thereof. The electric steering system also has advantages as follows:

The electric steering system supporting both wire or wireless installation, and avoids a complex installation. Moreover, the system avoids a complex oil circuit and a risk of oil leakage, it can run at both high and low temperature environments and requires little maintenance. The actuating device provides a steering torque via the electric motor, which greatly reduces a burden of the operator and saves effort operating the steering device.

The whole actuating device can be internally installed and fixed in a steering tube via a guide screw and a guide screw nut, thus a structure which is parallel with the steering tube and arranged externally as in the prior art can be omitted. In the prior art, additions to the structure of an actuating device will increase its size and introduce interference with other fittings, it's a real concern especially when using of the hydraulic steering system which often has a large size. The actuating device of small size can be suitable for many more and various propulsion apparatuses.

DETAILED DESCRIPTION

Figure 1:
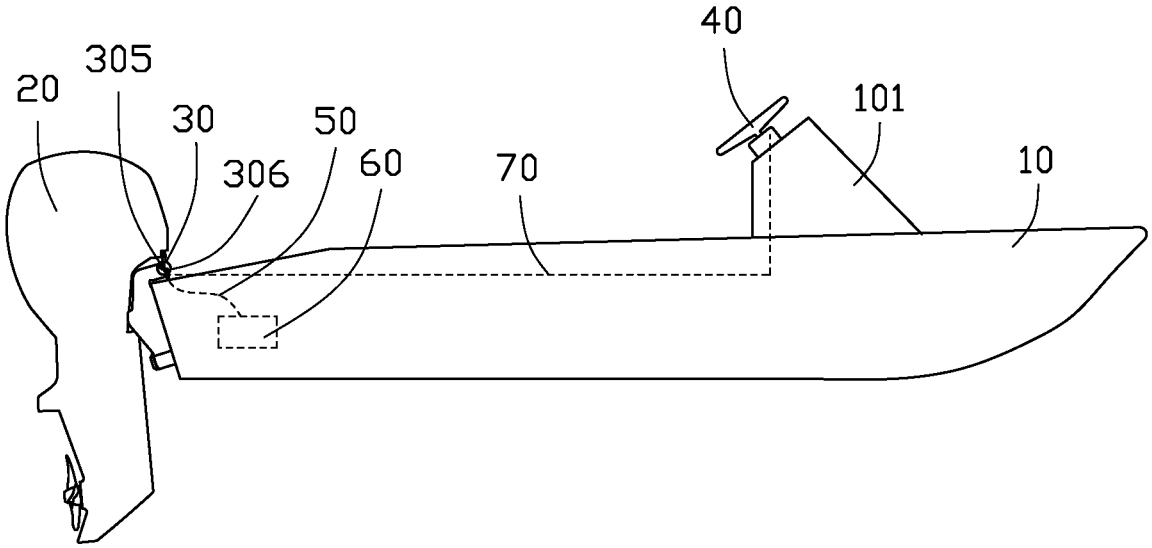
FIG. 1 is a side view of a boat according to the present disclosure.

Clear and complete description will be made to technical schemes of the present disclosure in conjunction with corresponding drawings in the embodiment of the present disclosure. Obviously, the described embodiments are merely a part of the embodiments of the present disclosure and not all the embodiments. Based on the embodiments of the present disclosure, all other embodiments obtained by those ordinarily skilled in the art without creative work fall within the scope of protection of the present disclosure.

Referring to FIG. 1 to FIG. 5, a boat includes a hull 10 and a ship propulsion apparatus 20. The ship propulsion apparatus 20 includes an electric steering system 1, a holding assembly, a link arm 202, and a rotatable assembly 203. The holding assembly is fixed to the hull 10. The rotatable assembly 203 is fixed to the holding assembly and can rotate along a substantially vertical axis with respect to the holding assembly.

The electric steering system 1 includes an actuating device 30 and a steering device 40. The holding assembly includes a steering tube 201 arranged in a horizontal direction. The actuating device 30 is fixed to a steering tube 201. The actuating device 30 is coupled to the rotatable assembly 203 via the link arm 202. The actuating device 30 is coupled to the rotatable assembly 203 to drive the ship propulsion apparatus 20 to rotate along a substantially vertical axis with respect to the steering tube 201.

The steering device 40 generates and transmits steering signals to the actuating device 30 in response to user operations. The actuating device 30 includes an electric motor 301. The electric motor 301 rotates to drive the link arm 202 to rotate. The link arm 202 drives the rotatable assembly 203 to rotate, thus to change the orientation of the ship propulsion apparatus 20.

The steering signal includes at least one angle value and an angle direction. The angle direction includes counter-clockwise direction and clockwise directions. The angle value can be detected via a position sensor of the steering device 40. The angle direction can be calculated by the second controller of the steering device 40 according to a number of angle values.

Figure 3:
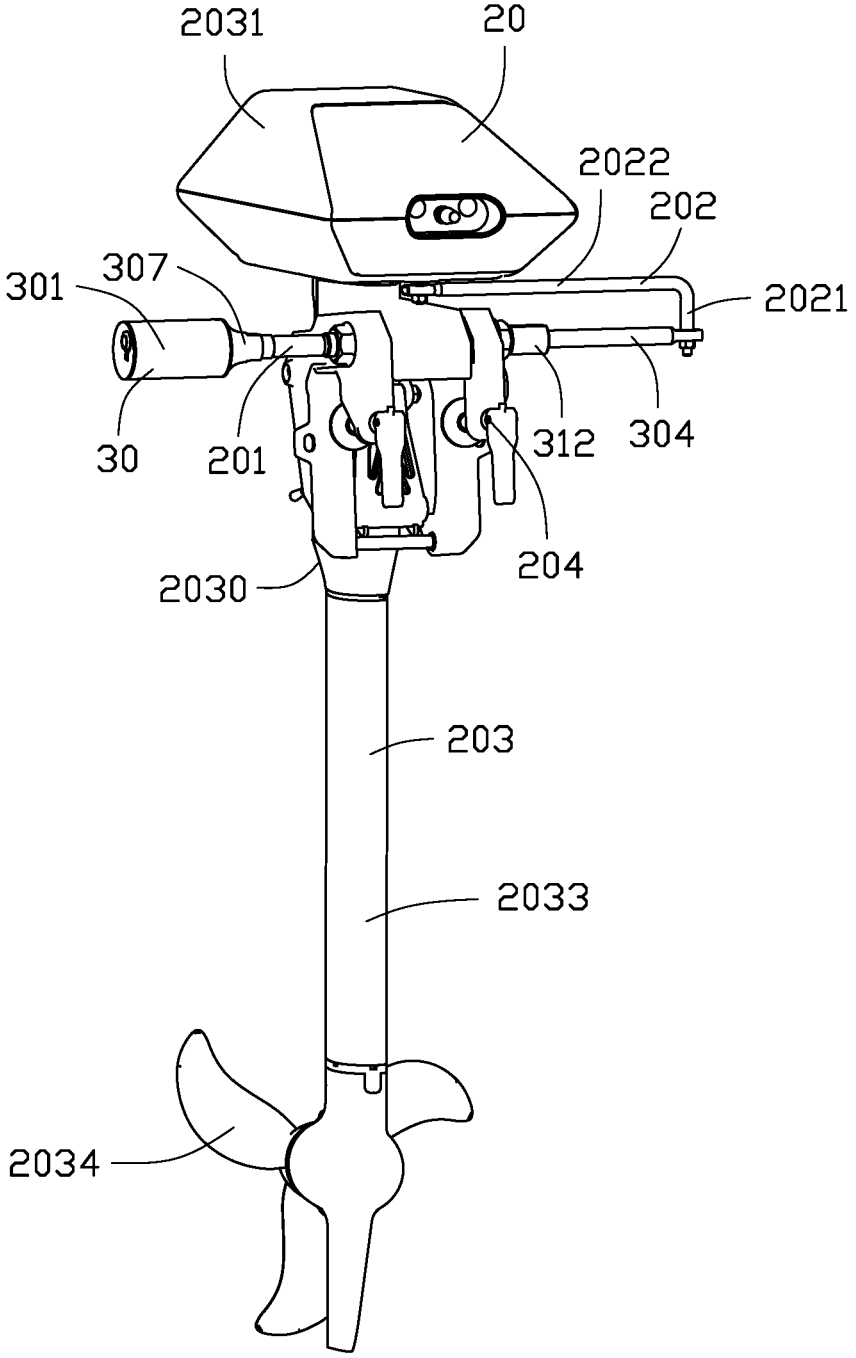
FIG. 3 is a schematic view of a ship propulsion apparatus including an actuating device of an electric steering system according to the present disclosure.
Figure 4:
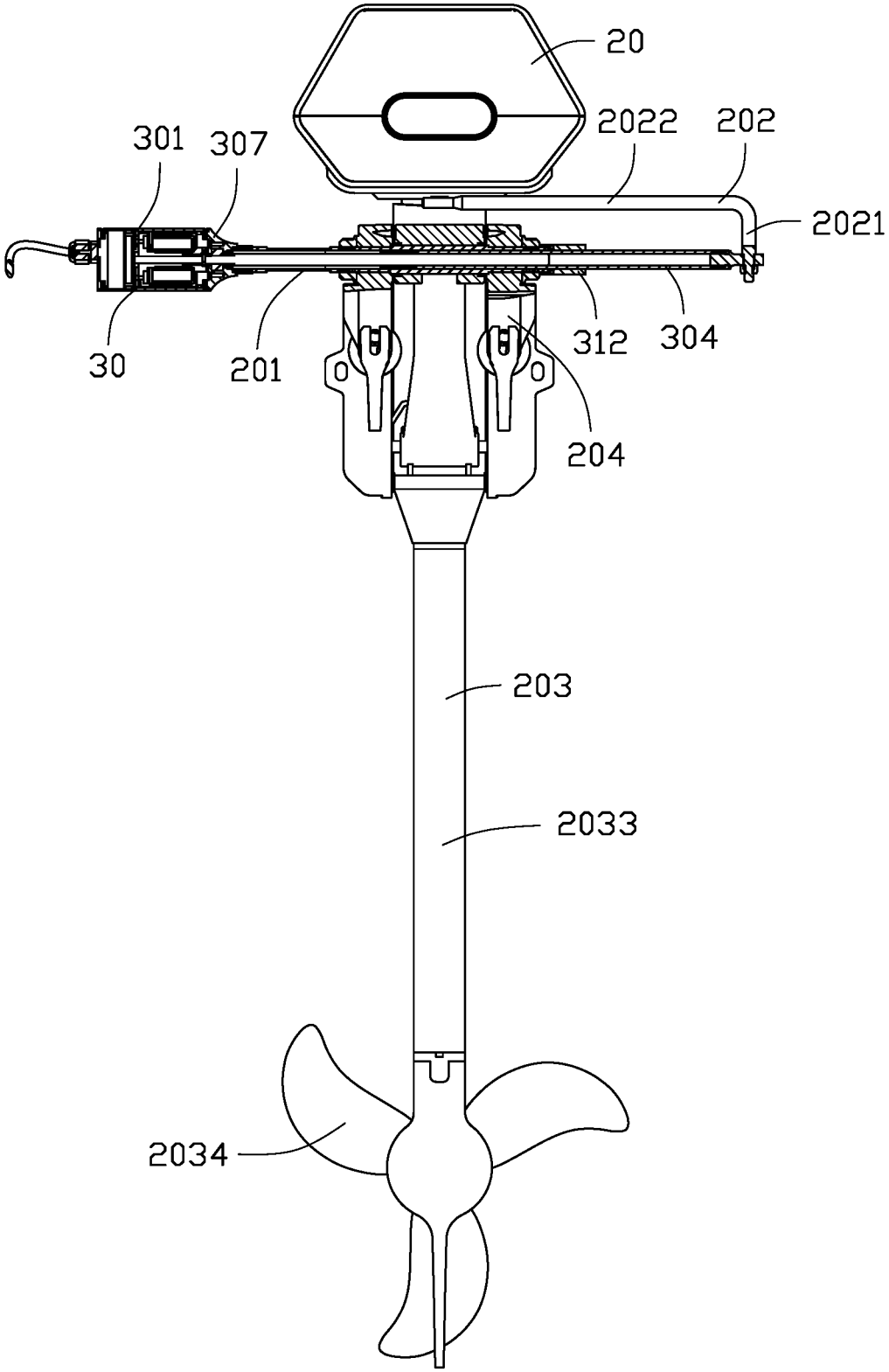
FIG. 4 is a cross-section view of part of the ship propulsion apparatus of FIG. 3.

As shown in FIG. 3, the holding assembly further includes a bracket 204. The rotatable assembly 203 includes a ship propulsion apparatus housing 2030 and a propeller 2034. A power device 2035 is arranged in the ship propulsion apparatus housing 2030. The power device 2035 is coupled to and drives the propeller 2034 to rotate. A first end of the link arm 202 is coupled to the actuating device 30, and a second end of the link arm 202 is coupled to the ship propulsion apparatus housing 2030. The actuating device 30 drives the link arm 202 to rotate. The link arm 202 drives the rotatable assembly 203 to rotate to adjust an orientation of the propeller 2034 in a horizontal direction, thus the direction of propulsion can be adjusted.

The power device 2035 can be arranged in an upper portion of the ship propulsion apparatus housing 2030 or a lower portion of the ship propulsion apparatus housing 2030. When the power device 2035 is arranged in an upper portion of the ship propulsion apparatus housing 2030, the power device 2035 is coupled to the propeller 2034 via a transmission shaft. When the power device 2035 is arranged in a lower portion of the ship propulsion apparatus housing 2030, the power device 2035 is coaxially coupled to the propeller 2034.

Figure 5:
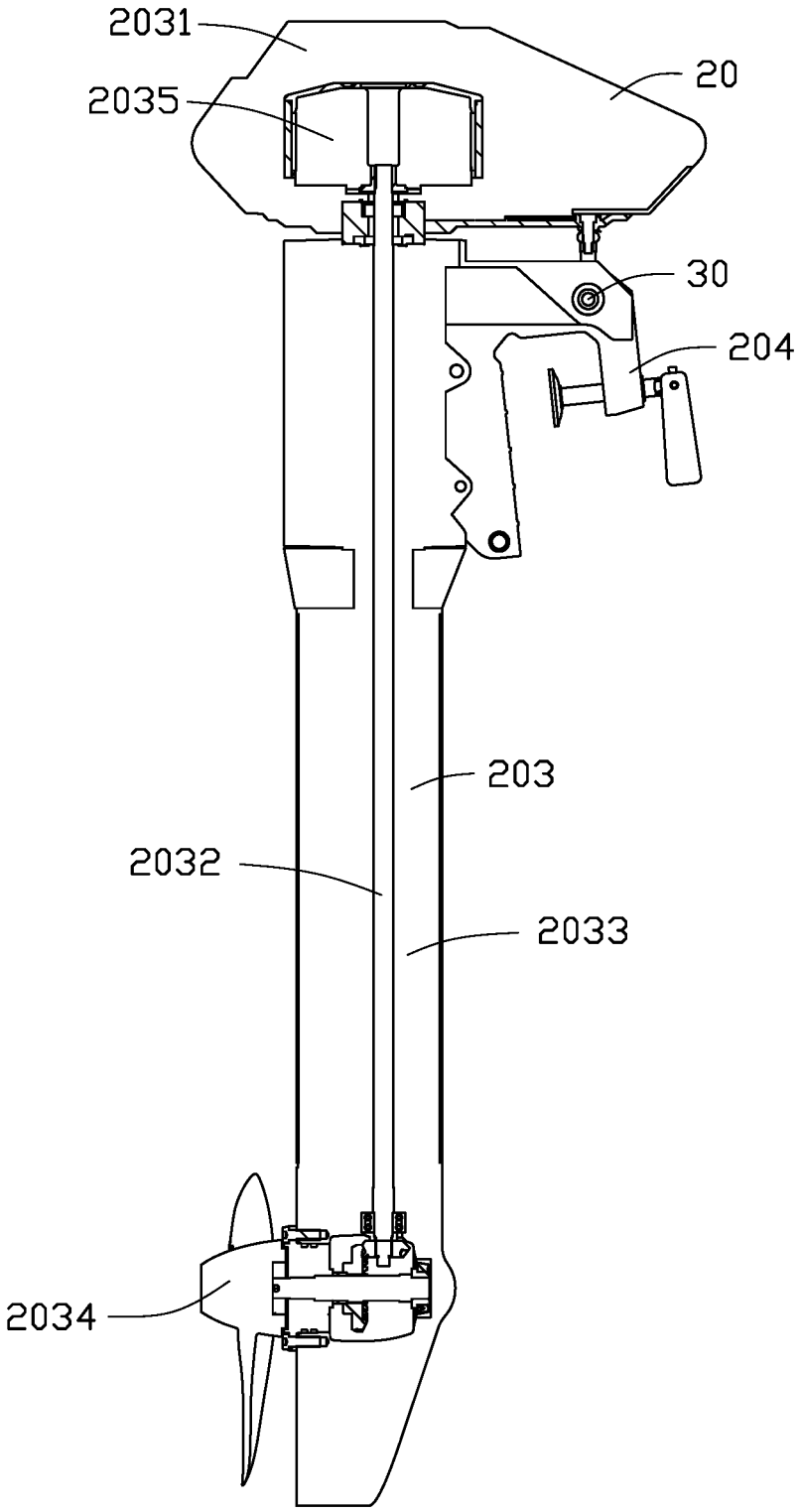
FIG. 5 is a cross-sectional view of the ship propulsion apparatus of FIG. 3, viewed from another perspective.
Figure 6:
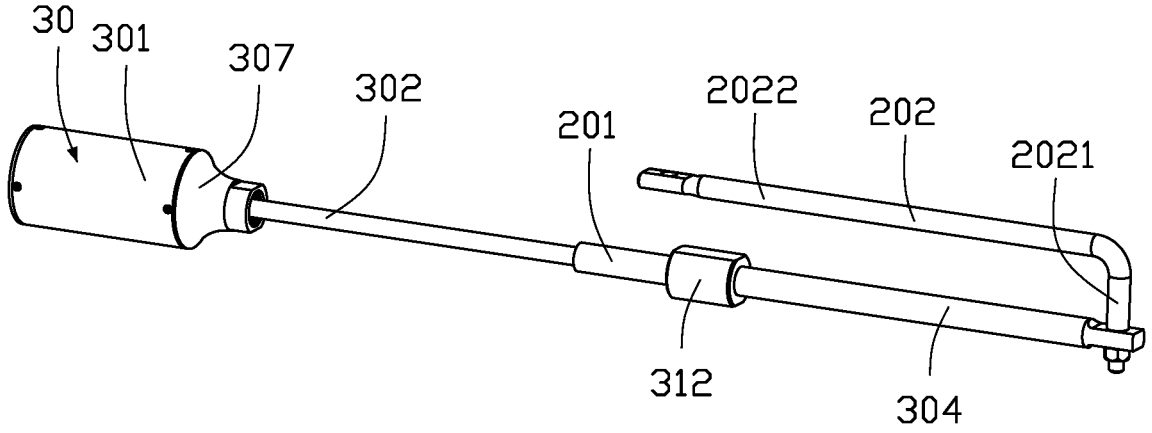
FIG. 6 is a schematic view of an actuating device of an electric steering system and part of other components of a ship propulsion apparatus, omitting a part of the steering tube according to the present disclosure.

In one embodiment, as shown in FIG. 5, the power device 2035 is installed in the upper portion of the ship propulsion apparatus housing 2030. The ship propulsion apparatus housing 2030 includes an upper casing 2031 and a main shaft supporting casing 2033. The upper casing 2031 is fixed on a top of the main shaft supporting casing 2033. The power device 2035 is installed in the upper casing 2031. The propeller 2034 is installed at a lower end of the main shaft supporting casing 2033. A vertical transmission shaft, namely a propulsion apparatus main shaft 2032, is arranged between the power device 2035 and the propeller 2034. An upper end of the propulsion apparatus main shaft 2032 is coupled to the power device 2035 via gearbox assembly, and a lower end of the propulsion apparatus main shaft 2032 is coupled to the propeller 2034 via two orthogonally engaged bevel gears. Namely, the power device 2035 is coupled to the propeller 2034 via the propulsion apparatus main shaft 2032. Thus, the rotation of the power device 2035 can rotate the propeller 2034 to provide a propulsion for the boat. The ship propulsion apparatus 20 is attached to the transom of the hull 10 via the bracket 204. The steering tube 201 is arranged on the bracket 204 along a horizontal direction. The electric steering system 1 is fixed in the steering tube 201. The actuating device 30 is attached to the steering tube 201. The second end of the link arm 202 is hinged to the upper portion of the ship propulsion apparatus housing 2030, for example via a bolt and a nut. Preferably, the second end of the link arm 202 is hinged to a bottom of the upper casing 2031.

The power device 2035 can be an electric motor.

Figure 7:
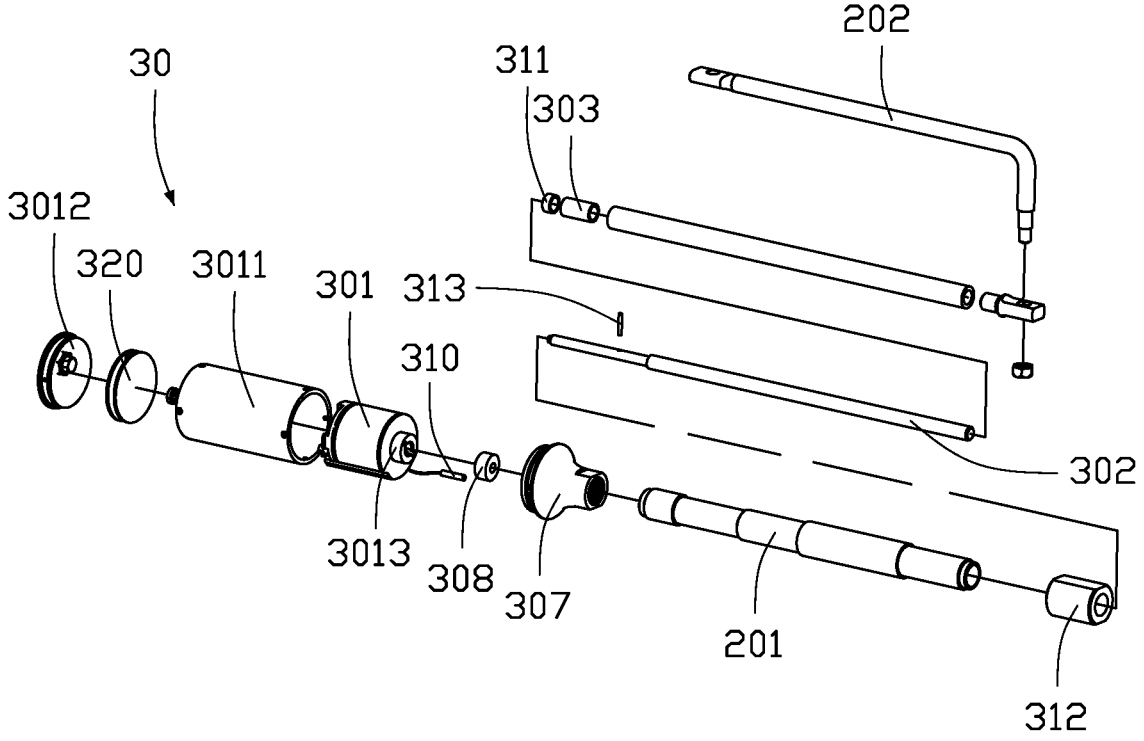
FIG. 7 is an exploded view of an actuating device of an electric steering system and part of other components of a ship propulsion apparatus according to the present disclosure.
Figure 8:
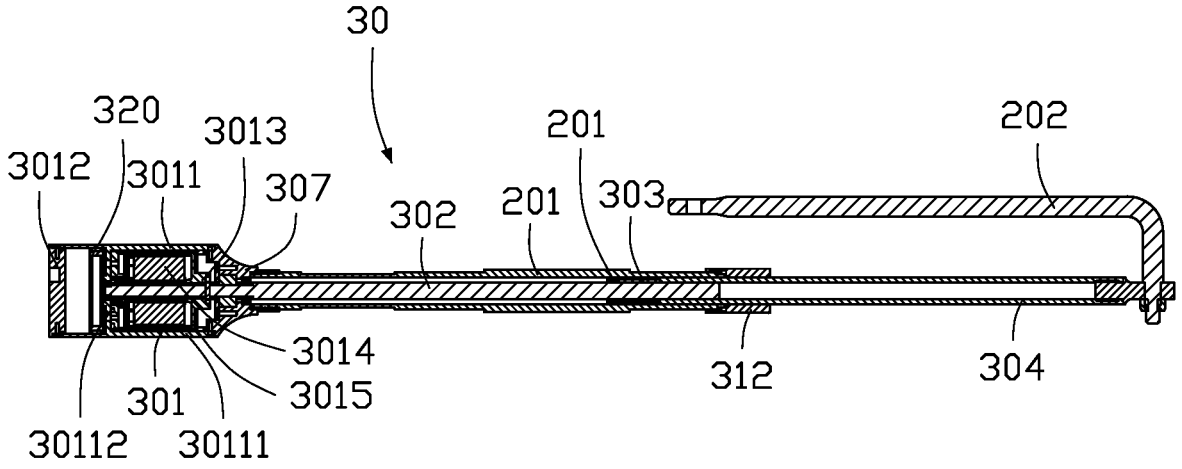
FIG. 8 is a cross-sectional view of an actuating device of an electric steering system and part of other components of a ship propulsion apparatus according to the present disclosure.

As shown in FIG. 3 to FIG. 13, the actuating device 30 further includes a first controller 330, a motor driver 320, a guide screw 302, a guide screw nut 303, and a first position sensor 350. As shown in FIG. 8, a first end of the guide screw 302 is fixed to an output shaft 3013 of the electric motor 301. The guide screw 302 is parallel with the steering tube 201. Optionally, the guide screw 302 is arranged outside or inside the steering tube 201. Optionally, the guide screw 302 and the steering tube 201 are coaxially arranged.

To reduce a size of the electric steering system 1, preferably, the guide screw 302 is arranged inside the steering tube 201.

Figure 2:
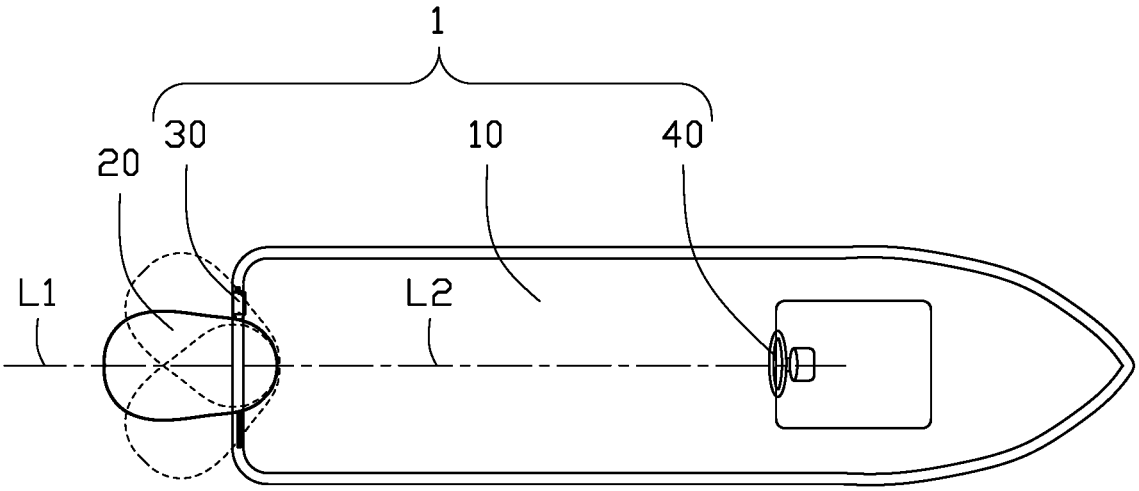
FIG. 2 is a top view of a boat of FIG. 1.

The guide screw nut 303 is threaded on the guide screw 302. The guide screw nut 303 is directly or indirectly coupled to the first end of the link arm 202. The electric motor 301 rotates to bring the guide screw 302 to rotate, causing the guide screw nut 303 move in a straight line along the guide screw 302. The guide screw nut 303 includes a first position and a second position on the guide screw 302. The first position is nearest to the electric motor 301. The second position is farthest from the electric motor 301. The steering device 40 at a clockwise and counterclockwise limit position correspond to the first position and the second position respectively. The first position and the second position are both located at the guide screw 302. The guide screw 302 further includes a third position between the first position and the second position. When the guide screw nut 303 is at the third position, a vertical central plane of the ship propulsion apparatus 20 which is a dash-dot line labeled with L1 as shown in FIG. 2 is parallel with a major axis of the boat which is a dash-dot line labeled with L2 as shown in FIG. 2.

The propulsion of the ship propulsion apparatus 20 causes the boat to move forward or backward. The position of the guide screw nut 303 on the guide screw 302 and the rotation angle travel of the steering device 40 have a one-to-one mapping relationship. On the same ship propulsion apparatus 20, the mapping relationship can be linear or nonlinear. However, an angle position of the steering device 40 corresponds to a unique position of the guide screw nut 303 on the guide screw 302 in a one-to-one mapping relationship.

The first controller 330 is electrically coupled to the first position sensor 350 and the motor driver 320. The first controller 330 is configured to transmit a control signal to the motor driver 320 to control a rotation direction and a rotation number of the electric motor 301 according to the received steering signal from the steering device 40. The motor driver 320 is configured to receive the control signal to drive the electric motor 301 to rotate. The electric motor 301 rotates the guide screw 302, causing the guide screw nut 303 to move in a straight line along the guide screw 302 and to move the link arm 202.

The first position sensor 350 is configured to detect a rotation number of the electric motor 301 and feedback the rotation number to the first controller 330. Accordingly, the first controller 330 controls a rotation of the electric motor 301, causing the guide screw nut 303 to be located between the first position and the second position. When the guide screw nut 303 is located at the first position or the second position, the first controller 330 controls the electric motor 301 to stop rotating. The first controller 330 further calculates a rotation number during sample time of the electric motor 301 according to the rotation number of the electric motor 301 transmitted from the first position sensor 350. When the rotation number of the electric motor 301 during the sample times of the electric motor 301 is zero, and the guide screw nut 303 is not at the first position or the second position, the first controller 330 controls the electric motor 301 to stop rotating. Based on the rotation number of the electric motor 301 detected by the first position sensor 350, the electric motor 301 can be controlled by a closed-loop. The first position sensor 350 can be a Hall sensor or an encoder.

In one embodiment, the actuating device 30 further includes a rod 304. The guide screw nut 303 is coupled to the first end of the link arm 202 via the rod 304. The rod 304 is hollow. The guide screw 302 and the guide screw nut 303 are arranged in the steering tube 201 and each coaxially arranged with the steering tube 201. The guide screw nut 303 brings the rod 304 to move in a straight line along the guide screw 302, to bring the first end of the link arm 202 to move in a straight line along the guide screw 302.

The actuating device 30 further includes a position switch 310 for detecting the first position and/or the second position. The position switch 310 is electrically coupled to the first controller 330 to transmit the switch signal to the first controller 330. The first controller 330 receives the switch signal and controls the electric motor 301 to stop rotating or rotate in reverse.

The position switch 310 can be replaced by a position sensor, for example, a photoelectronic sensor or an ultrasonic sensor. The position switch 310 is configured to transmit the detected distance information to the first controller 330, and the first controller 330 controls the rotation of the electric motor 301 according to the detected distance information.

The motor driver 320 is installed at an end of the electric motor 301 far away from the steering tube 201. Preferably, the first controller 330 and the motor driver 320 are integrated in a housing of the electric motor 301. The first controller 330 and the motor driver 320 are integrated on the same circuit board.

The housing of the electric motor 301 includes a front casing 3011 and a rear casing 3012. A stator 3014 and a rotor 3015 of the electric motor 301 are arranged in the front casing 3011. The front casing 3011 includes a tubular member 30111 and a radially extending member 30112. The radially extending member 30112 is located behind the stator 3014 and the rotor 3015. The rear casing 3012 is fixed to a rear end of the front casing 3011 (tubular member 30111). The tubular member 30111, the radially extending member 30112, and the rear casing 3012 form a receiving space. The motor driver 320 is installed behind the radially extending member 30112 and is received in the receiving space. A power cable joint 305 and a signal cable joint 306 are arranged on the rear casing 3012. The motor driver 320 is electrically coupled to the power device via the power cable joint 305, to provide power for the electric motor 301, the first controller 330, and the first position sensor 350 via the power device. The first controller 330 is electrically coupled to the steering device 40 via the signal cable joint 306.

In one embodiment, an interior of the front casing 3011 of the electric motor 301 forms the receiving space to install the motor driver 320 and the first controller 330. The power cable joint 305 and the signal cable joint 306 are preferably arranged on the front casing 3011 of the electric motor 301. The rear casing 3012 and the front casing 3011 are connected in a sealing manner with a static sealing member. The front casing 3011 and a connector 307 (as shown in FIG. 3) are connected and sealed. A dynamic sealing member 309 is arranged between the connector 307 and the guide screw 302. The rear casing 3012, the front casing 3011, and the connector 307 form a sealed and waterproof receiving space. Thus, the electric motor 301, the first controller 330, the motor driver 320, and the position switch 310 are protectively arranged in a sealed waterproof environment.

Preferably, the electric motor 301 is an outer rotor motor. The electric motor 301 includes the stator 3014 and the rotor 3015. The central of the stator 3014 defines a through hole. One end of the guide screw 302 extends and passes through the through hole. The guide screw 302 is coupled to the rotor 3015 via at least one bearing.

Preferably, the first controller 330, the motor driver 320, the electric motor 301, the position switch 310, the guide screw 302, and the guide screw nut 303 are arranged in turn along a radial direction of the steering tube 201 in sequence from left to right. Or the electric motor 301, the motor driver 320, the first controller 330, the position switch 310, the guide screw 302, and the guide screw nut 303 can be arranged in turn along the radial direction of the steering tube 201 in sequence.

As shown in FIG. 1 and FIG. 2, the power cable joint 305 is electrically coupled to a power device 60 via a power cable 50. The signal cable joint 306 is communicationally coupled to the steering device 40 via a signal cable 70. The first controller 330 communicates with the steering device 40 via wires.

Figure 13:
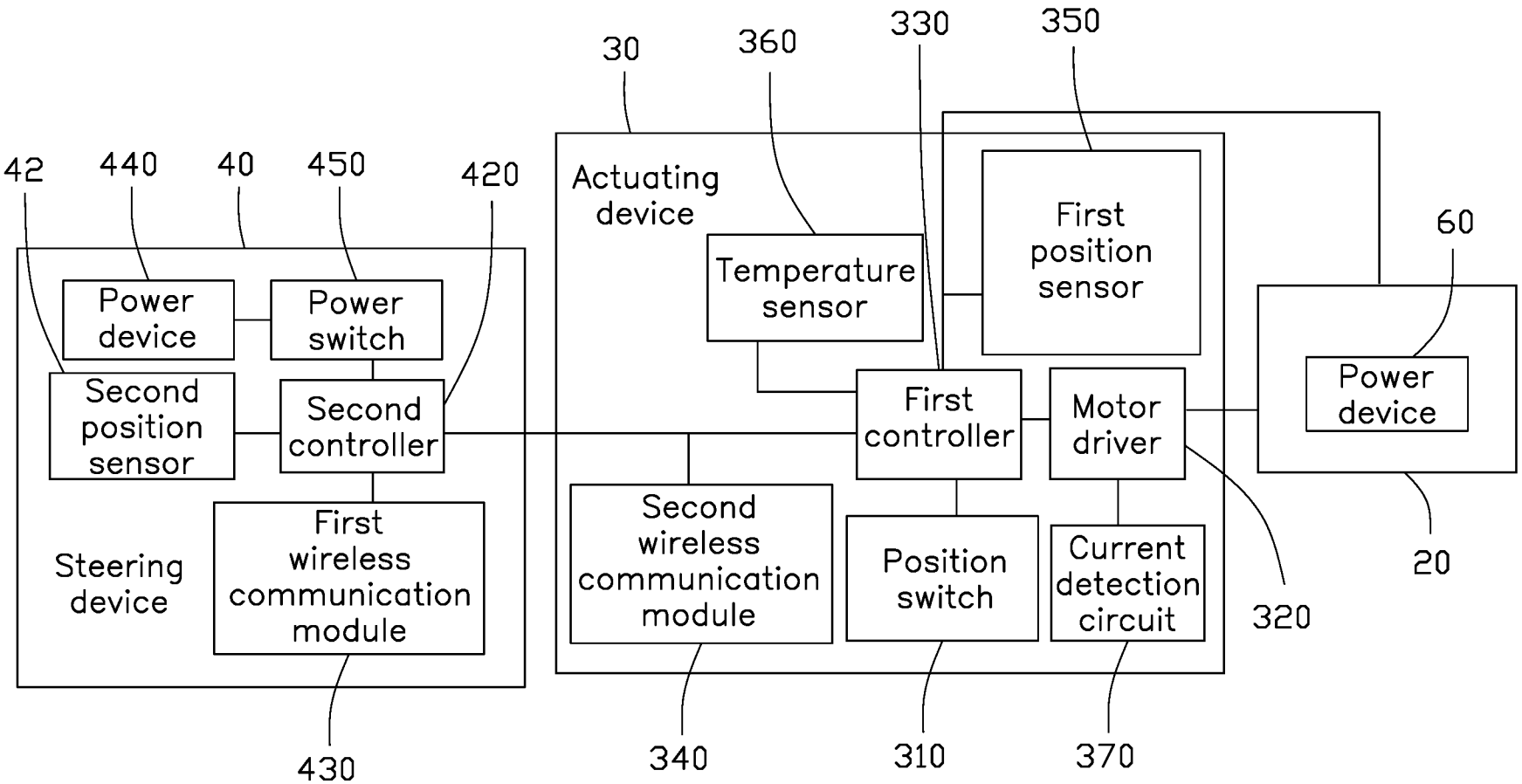
FIG. 13 is a block diagram of an electric steering system according to the present disclosure.

In one embodiment, as shown in FIG. 13, the actuating device 30 is coupled to the power device 60 of the ship propulsion apparatus 20 via the power cable 50, to provide power for the first controller 330 and the motor driver 320. The steering device 40 is self-powered via the power device 440. The steering device 40 communicates with the actuating device 30 wirelessly.

In an alternative embodiment, the steering device 40 is coupled to the actuating device 30 via wires. The steering device 40 communicates with the actuating device 30 via wires. Further the steering device 40 obtains power via the actuating device 30. The steering device 40 and the actuating device 30 share a power device. The ship propulsion apparatus 20 is powered by the power device 60. Or the steering device 40, the actuating device 30, and the ship propulsion apparatus 20 can share the power device 60.

The actuating device 30 further includes the connector 307 for coupling the electric motor 301 to the steering tube 201. The connector 307 is trumpet-shaped. A larger outer diameter of the connector 307 is fixed to the housing of the electric motor 301 via screw, and a smaller outer diameter of the connector 307 is threadedly coupled on an outer surface of the steering tube 201. The connector 307 is threadedly coupled to the steering tube 201, and no installation tool is needed. Thus, an installation is simply, a "plug and play" installation can be achieved.

The guide screw 302 passes through the connector 307 to be coupled to the electric motor 301. A double row angular contact bearing 308 and the dynamic sealing member 309 are arranged in an inner hole of the connector 307. An outer ring of the double row angular contact bearing 308 is an interference fit with a wall of the inner hole of the connector 307. An inner ring of the double row angular contact bearing 308 is attached to the guide screw 302. An outer ring of the dynamic sealing member 309 is an interference fit with the wall of the inner hole of the connector 307. An inner ring of the dynamic sealing member 309 is attached to the guide screw 302. The double row angular contact bearing 308 is behind the dynamic sealing member 309. The dynamic sealing member 309 seals the electric motor 301. Sealing the electric motor 301 with the dynamic sealing member 309 achieves waterproofing. Thus, the electric motor 301 and other electrical components of the housing are protected.

In other embodiments, the connector 307 and the steering tube 201 are fixed via holding axis. The double row angular contact bearing 308 can be replaced by two angular contact bearings or other bearing or a combination of bearings capable of bearing bidirectional axial forces.

The position switch 310 is arranged in the connector 307 and is electrically coupled to the first controller 330 via a cable. The front casing 3011 or the stator 3014 of the electric motor 301 defines a cable groove to receive the cable. The cable passes through the cable groove to be electrically coupled to the first controller 330.

One end of the rod 304 is slidably inserted into the steering tube 201 and is attached to the other end of the guide screw 302. The guide screw nut 303 is fixed to an inner wall of an end of the rod 304 adjacent to the electric motor 301. The actuating device 30 further includes a magnet 311. The magnet 311 is fixed to the end of the rod 304 adjacent to the electric motor 301 or is fixed to an end of the guide screw nut 303 adjacent to the electric motor 301. A distance between the rod 304 and the position switch 310 is A, and a distance between the guide screw nut 303 and the position switch 310 is B. Preferably, the magnet 311 is fixed according to the smaller distance of A and B. The magnet 311 moves together with the rod 304.

Figure 9:
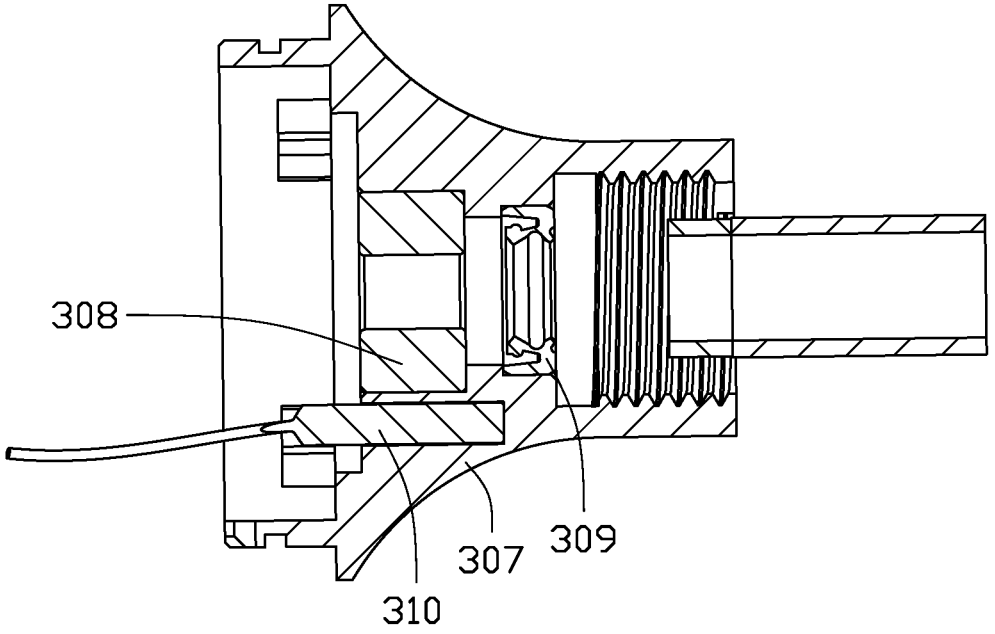
FIG. 9 is a cross-sectional view of a connector of an actuating device of an electric steering system according to the present disclosure.

As shown in FIG. 9, the position switch 310 is a reed switch. The magnet 311 is fixed to the end of the guide screw nut 303 adjacent to the position switch 310. The reed switch detects whether the guide screw nut 303 is at the first position and/or the second position by detecting the magnet 311, thus a position calibration and a limit protection are achieved.

After the electric steering system 1 is powered on, the system is initialized. The guide screw nut 303 and the magnet 311 move toward the electric motor 301 in default. When the distance between the magnet 311 and the position switch 310 exceeds a threshold value, a state change of the position switch 310 occurs. The first controller 330 controls the electric motor 301 to stop rotating, records the rotation number of the electric motor 301 measured by the first position sensor 350 (encoder or Hall sensor) after the electric motor 301 stops rotating, and sets the rotation number of the electric motor 301 as an initialization reference value. The first controller 330 records current position to be an initialization position. The first controller 330 stores a theoretically maximal rotation number of the electric motor 301.

According to a travel length L of the guide screw 302, suppose the distance brought by the guide screw 302 to the rod 304 per rotation of the electric motor 301, namely a movement rate on the guide screw 302 is 1, thus the theoretically maximal rotation number that the electric motor 301 can rotate from the initialization position is $\Delta n = L/1$. The first controller 330 obtains the rotation number of the electric motor 301 and the rotation direction of the electric motor 301 from the first position sensor 350, calculates a current position of the guide screw nut 303, or the rod 304, or the link arm 202 according to the rotation number of the electric motor 301 and the rotation direction of the electric motor 301, and limits incrementation of the rotation number relative to the initialization reference value not more than $\Delta n$.

In other embodiments, the position switch 310 can be a Hall switch, or a photoelectronic switch, or a Hall sensor, or a photoelectronic sensor, an ultrasonic sensor, or other non-contact position switch.

The actuating device 30 further includes a supporting sleeve 312. One end of the supporting sleeve 312 is threadedly coupled to the steering tube 201. An outer surface of the guide screw 302 contacts an inner surface of the rod 304 to form an inner guide, and an outer surface of the rod 304 contacts the supporting sleeve 312 to form an outer guide. The supporting sleeve 312 can support a free end of the rod 304, to reduce radial runout and improve coaxiality of the electric steering system 1 and a use life.

In one embodiment, a shape of the link arm 202 is "L". The link arm 202 includes a vertical rod 2021 and a horizontal rod 2022. A first end of the horizontal rod 2022 is coupled to an upper end of the vertical rod 2021, and a second end of the horizontal rod 2022 is hinged to the rotatable assembly 203. The actuating device 30 is rotatably coupled to a lower end of the vertical rod 2021.

In one embodiment, the second end of the horizontal rod 2022 is hinged to the upper portion of the ship propulsion apparatus housing 2030. The guide screw nut 303 is coupled to the lower end of the vertical rod 2021 via the rod 304. The rod 304 defines a through hole. The lower end of the vertical rod 2021 includes outer thread. The lower end of the vertical rod 2021 upwardly extends the through hole and is threadedly coupled to a nut. Thus, a hinging between the link arm 202 and the rod 304 can be achieved. A rotation axis of the horizontal rod 2022 and a central axis of the propulsion apparatus main shaft 2032 are parallel and spaced from each other, thus a flexible rotation of the connection rod 202 is achieved.

In other embodiments, a height of the first end of the link arm 202 coupled to the actuating device 30 in a vertical direction is the same as a height of the second end of the link arm 202 coupled to the rotatable assembly 203 in the vertical direction. The link arm 202 can be a straight bar. In other embodiments, the link arm 202 can be the bar with other shape and having at least the horizontal rod 2022.

As shown in FIG. 7, the output shaft 3013 of the electric motor 301 and the guide screw 302 are coaxially arranged. The output shaft 3013 of the electric motor 301 and the guide screw 302 are arranged and coupled to each other via a pin or a coupler.

In other embodiments, the output shaft 3013 of the electric motor 301 is a hollow shaft. The guide screw 302 extends and passes through the output shaft 3013 of the electric motor 301 along a radial direction. At least two supporting bearings are arranged at left and right ends of the electric motor 301 to support the guide screw 302. Thus, coaxiality between the electric motor 301 and the guide screw 302 is improved. Preferably, each of the supporting bearings is the double row angular contact bearing 308.

In other embodiments, the electric motor 301 and the guide screw 302 are not coupled coaxially. An installation position of the ship propulsion apparatus 20 may be made concave, thus the electric motor 301 and the guide screw 302 are not coupled coaxially, an entire length and a size of the actuating device 30 can be reduced to adapt to the above installation after the actuating device 30 is installed.

In other embodiments, the output shaft 3013 of the electric motor 301 and the guide screw 302 are integrated.

The actuating device 30 further includes a current detection circuit 370 for detecting a current consumption of the electric motor 301 or the motor driver 320. The current detection circuit 370 is electrically coupled to the first controller 330. The first controller 330 controls the electric motor 301 or the motor driver 320 to stop rotating according to the current when greater than the preset threshold.

Optionally, the current detection circuit 370 includes a Hall current sensor.

The actuating device 30 further includes a temperature sensor 360 for measuring a temperature of the electric motor 301 or the motor driver 320. The temperature sensor 360 is electrically coupled to the first controller 330. The first controller 330 controls the electric motor 301 or the motor driver 320 to stop rotating when the temperature is greater than the preset threshold.

Figure 10:
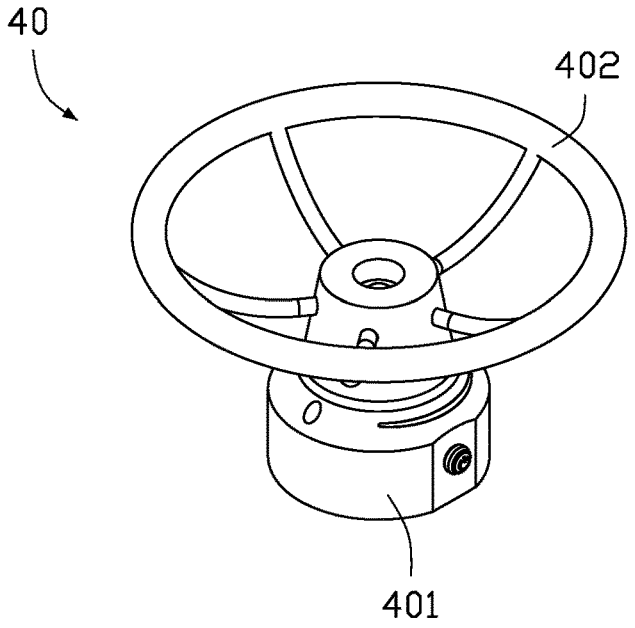
FIG. 10 is a schematic view of a steering device of an electric steering system according to the present disclosure.
Figure 11:
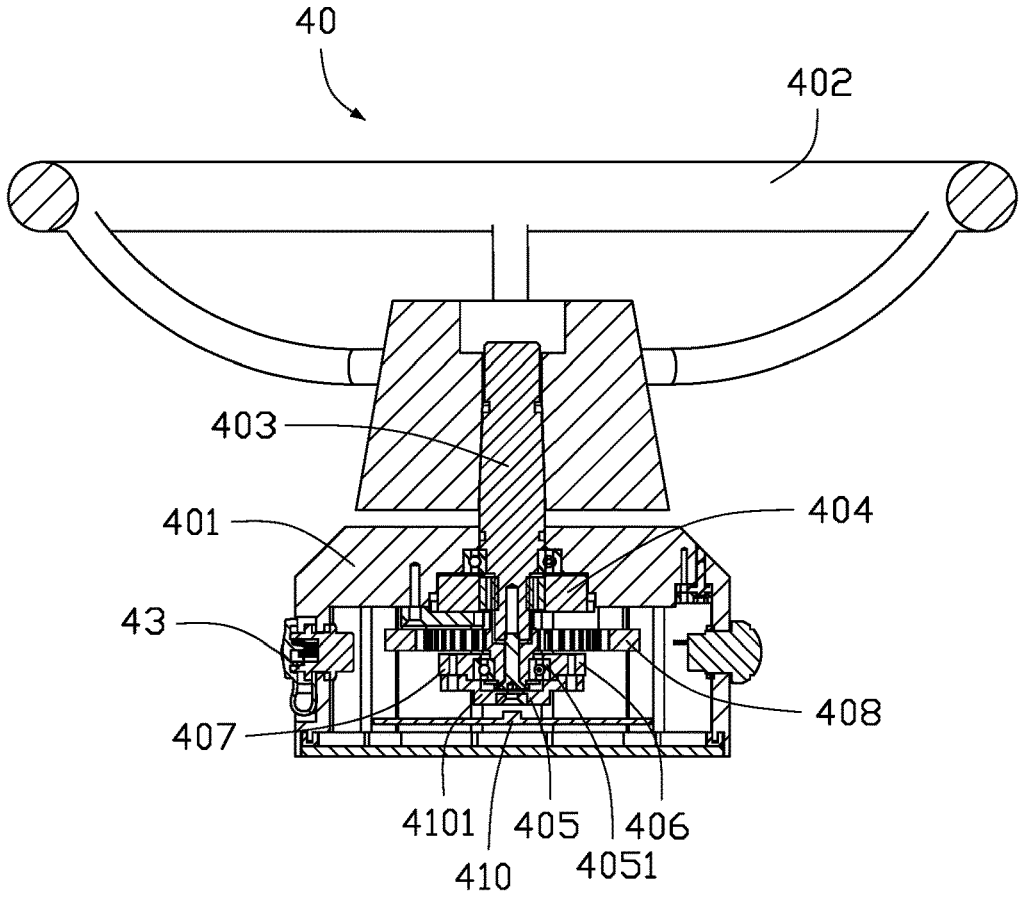
FIG. 11 is a cross-sectional view of the steering device of the electric steering system of FIG. 10.
Figure 12:
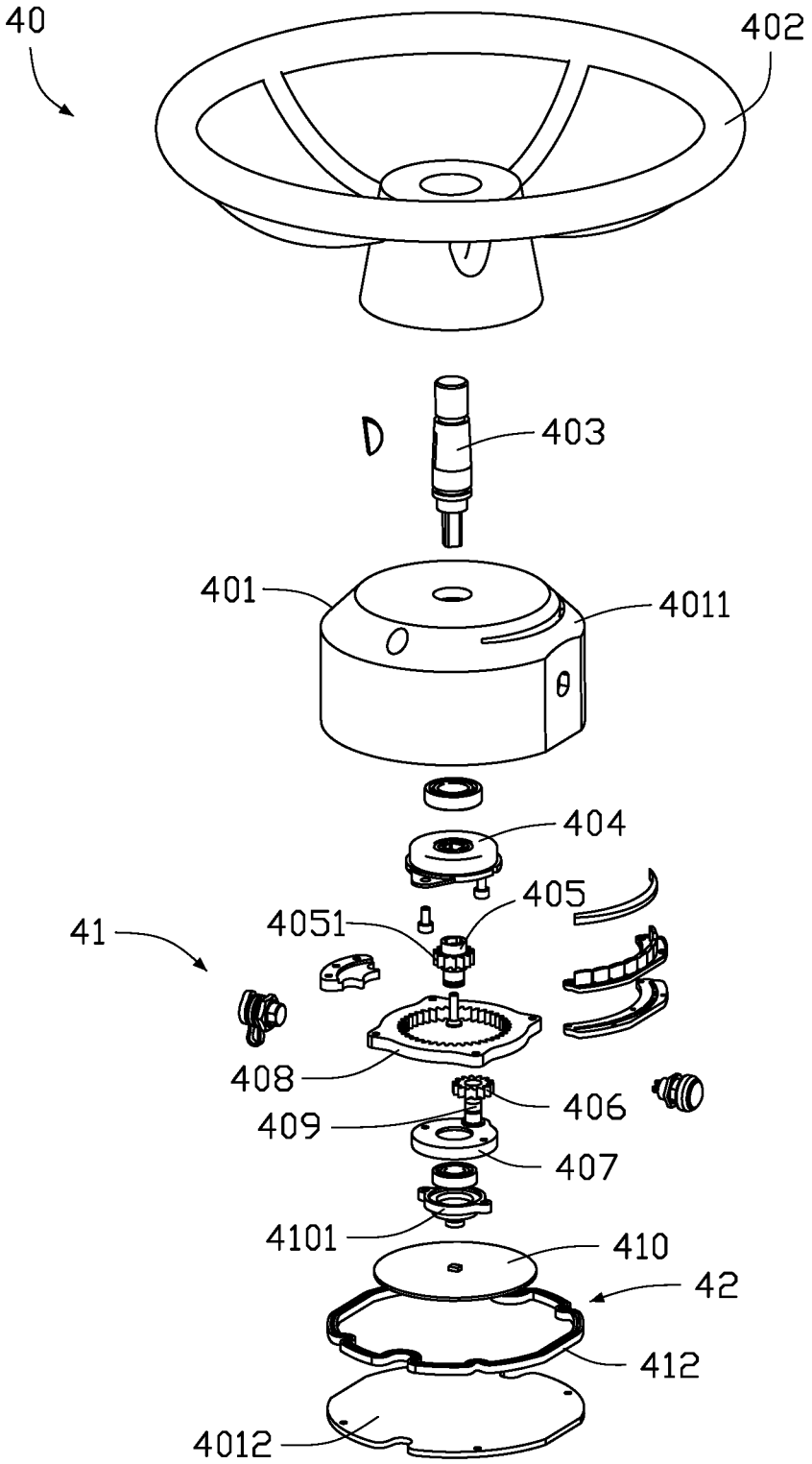
FIG. 12 is an exploded view of the steering device of the electric steering system of FIG. 10.

As shown in FIG. 1, FIG. 10, and FIG. 11, the steering device 40 includes a steering wheel 402, a steering shaft 403, a planetary gear sets 41, and the second position sensor 42. An input end of the planetary gear sets 41 is coupled to the steering shaft 403. The second position sensor 42 is configured to detect a rotation angle of the output end of the planetary gear sets 41.

The steering device 40 further includes a steering base 401 and a rotary damper 404. The steering base 401 defines an inner cavity. The rotary damper 404 and the second position sensor 42 are arranged in the inner cavity. The steering base 401 is installed in a console 101 of the hull 10. The steering wheel 402 is fixed to an upper end of the steering shaft 403. A lower end of the steering shaft 403 is rotatably inserted in the steering base 401 and extends into the inner cavity. An inner ring of the rotary damper 404 is fixed to the steering shaft 403, and an outer ring of the rotary damper 404 is fixed to the steering base 401, thus damping is applied to the rotation.

The planetary gear sets 41 includes a sun gear shaft 405, a planet gear 406, a planetary carrier 407, and an inner ring gear 408. The sun gear shaft 405 includes a sun gear 4051. An upper end of the sun gear shaft 405 is fixed to the lower end of the steering shaft 403. The planet gear 406 is engaged between the sun gear 4051 and the inner ring gear 408. An outer surface of the inner ring gear 408 is fixed in the steering base 401. The planet gear 406 is rotatably supported on the planetary carrier 407 via a pin 409. The planetary carrier 407 is below the inner ring gear 408, and rotatably mounted to a lower end of the sun gear shaft 405 via the bearing.

The second position sensor 42 includes a magnetic member 410 and a Hall position sensor 411. The magnetic member 410 is fixed to the planetary carrier 407. The Hall position sensor 411 is fixed in a bottom of the inner cavity. The Hall position sensor 411 detects a position variation of the magnetic member 410 to detect a rotation angle of the planetary carrier 407. Suppose a reduction ratio of the planetary gear sets 41 is Z, and an actual rotatable rotation angle travel of the steering wheel 402 is N, thus the angle range detected by the second position sensor 42 is from zero to N/Z. For example, a rotation travel of the steering wheel 402 is usually three complete circles which is 1080 degrees. The Hall position sensor can only detect an angle variation equal to a circle which is no more than 360 degrees, while the maximal rotation angle of the steering wheel 402 can be converted to 270 degrees by a 4 to 1 planetary gear sets 41. Thereby, an angle detection range of the Hall position sensor 411 can be suitable.

The magnetic member 410 is a magnet or a magnetogenic element.

Optionally, the second position sensor 42 can include several Hall position sensors 411 to increase detection accuracy and detection reliability. Optionally, each Hall position sensor 411 can be replaced by other position sensor, for example a photoelectronic sensor.

Optionally, one Hall position sensor is employed. The Hall position sensor is mounted below an axis of the steering shaft 403. The magnetic member 410 can be installed opposite to the Hall position sensor, or not opposite to the Hall position sensor. Preferably, the magnetic member 410 is installed opposite to the Hall position sensor and below the Hall position sensor.

Optionally, at least two Hall position sensors are employed. The Hall position sensors are evenly distributed on a circumference coaxially with the steering shaft 403. The magnetic member 410 is arranged on the axis of the steering shaft 403.

The rotary damper 404 is arranged on the steering shaft 403 to increase the damping during rotation of the steering wheel 402. Thus, an excessive rotation or over-rotation is prevented by the damping. Moreover, the steering wheel 402 can stay at any position when the steering wheel 402 is free from hold. That is, after any turning of the steering wheel 402 during boat movement, the steering wheel 402 can stay where the turning force put on the steering wheel 402 is released, there is no need of any continuous external force holding on the steering wheel 402.

Manner of connection between the steering shaft 403 and the below steering base 401 and between the steering wheel 402 and the below steering base 401 are standard connection manners of the steering wheel 402. The steering base 401 includes an upper cover 4011 and a lower cover 4012. The upper cover 4011 and the lower cover 4012 are coupled together to form a sealed housing. A sealing groove is defined between the upper cover 4011 and the lower cover 4012. A sealing ring 412 is formed between the upper cover 4011 and the lower cover 4012. The upper cover 4011 and the lower cover 4012 can threadedly press the sealing ring 412 to achieve a sealed waterproofing. A dynamic sealing structure is arranged at a connection position between the upper cover 4011 and the steering shaft 403 to achieve a sealed waterproofing.

The steering device 40 further includes a second controller 420. The second controller 420 is coupled to the first controller 330 and the Hall position sensor 411. The second controller 420 converts a rotation angle of the planetary carrier 407 (magnetic member 410) collected by the Hall position sensor 411 to the steering signal to the first controller 330. Thus, the steering device 40 at a counterclockwise limit position and at a clockwise limit position respectively correspond to the first position of the guide screw nut 303 and the second position of the guide screw nut 303.

In some embodiments, as shown in FIG. 13, a first wireless communication module 340 is coupled to the first controller 330, and a second wireless communication module 430 is coupled to the second controller 420. A wireless communication between the actuating device 30 and the steering device 40 can be achieved via a communication between the first wireless communication module 340 and the second wireless communication module 430.

The steering device 40 further includes an indicator light, a power switch 450, and a communication interface 43. The indicator light, the power switch 450, and the communication interface 43 are coupled to the second controller 420 and are arranged on the steering base 401. The indicator light can at least indicate an orientation deflection state of the ship propulsion apparatus 20, and/or a power-on state of the steering device 40, and/or the state of charge of the power device and any battery.

The second controller 420 controls a state of the indicator light to also indicate a current work mode or position of the steering wheel 402, for example, indicating a rotation direction of the steering wheel 402, such as counterclockwise or clockwise; or indicating a direction of the boat, such as toward left or toward right; or indicating a state of the built-in power device of the steering device 40, such as a normal charge or a low state of charge, or warning as to a malfunction of the second controller 420 or a communication malfunction.

The steering device 40 further includes a switch for starboard and port which adapts to that the actuating device 30 be installed at the starboard side or the port side selectively.

In one embodiment, the steering device 40 further includes a display to display at least one state of the ship propulsion apparatus 20, for example facing left or right, an orientation deflection angle of the ship propulsion apparatus 20, a power-on state of the steering device 40, for example whether the steering device 40 is powered on, and a charge of the power device, for example a residual charge, and whether the charge of the power device is sufficient. The display can replace the indicator light.

The steering device 40 further includes a neutral position button to calibrate a neutral position of the steering device 40, namely calibrate an angle position of the steering device 40 when an orientation of the propeller 2034 causes the propulsion direction of the boat to be straight ahead. During setting the electric steering system 1, the steering device 40 is rotated to a position to cause the actuating device 30 to adjust the orientation of the propeller 2034 until the propulsion orientation of the boat to be straight ahead. Then pressing the neutral position button causes the second controller 420 to save the angle position information of the steering device 40 and refer to the angle position information to calibrate the neutral position of the steering device 40.

When the steering device 40 is at the neutral position, the indicator light of the steering device 40 indicates that the position of the steering device 40 is at the neutral position. When the steering device 40 is not at the neutral position, the indicator light of the steering device 40 indicates that the orientation state of the steering device 40, for example toward left or right, thus users know the orientation state of the steering device 40.

The power switch 450 controls the steering device 40 to be powered on or powered off. The communication interface 43 is configured to couple to the actuating device 30 to enable a wired communication.

The operational principle of the electric steering system 1 is as follows:

The steering wheel 402 is rotated by the user, bringing the steering shaft 403 and the planetary gear sets 41 to rotate together. The second position sensor 42 sends a detected rotation angle (an analog data) of the planetary gear sets 41 to the second controller 420. The second controller 420 converts the rotation angle of the planetary gear sets 41 to be a digital steering signal and transmits the steering signal to the first controller 330 of the actuating device 30 via a wireless manner or a wire manner. The actuating device 30 drives the electric motor 301 to rotate according to the steering signal, accordingly adjusting the propulsion orientation of the ship propulsion apparatus 20.

The actuating device 30 obtains power via a power device of the ship propulsion apparatus 20 or an external power device. The steering device 40 can be self-powered or can obtain power from the actuating device 30 via cables.

In one embodiment, the ship propulsion apparatus 20 is an electric ship propulsion apparatus. The actuating device 30 and the steering device 40 are powered by the power device of the ship propulsion apparatus 20.

In an alternative embodiment, the steering device 40 can be replaced by a joystick controller. The joystick controller can operate a clockwise steering, a counterclockwise steering, an increase of the steering angle, and a reducing of the steering angle.

Figure 14:
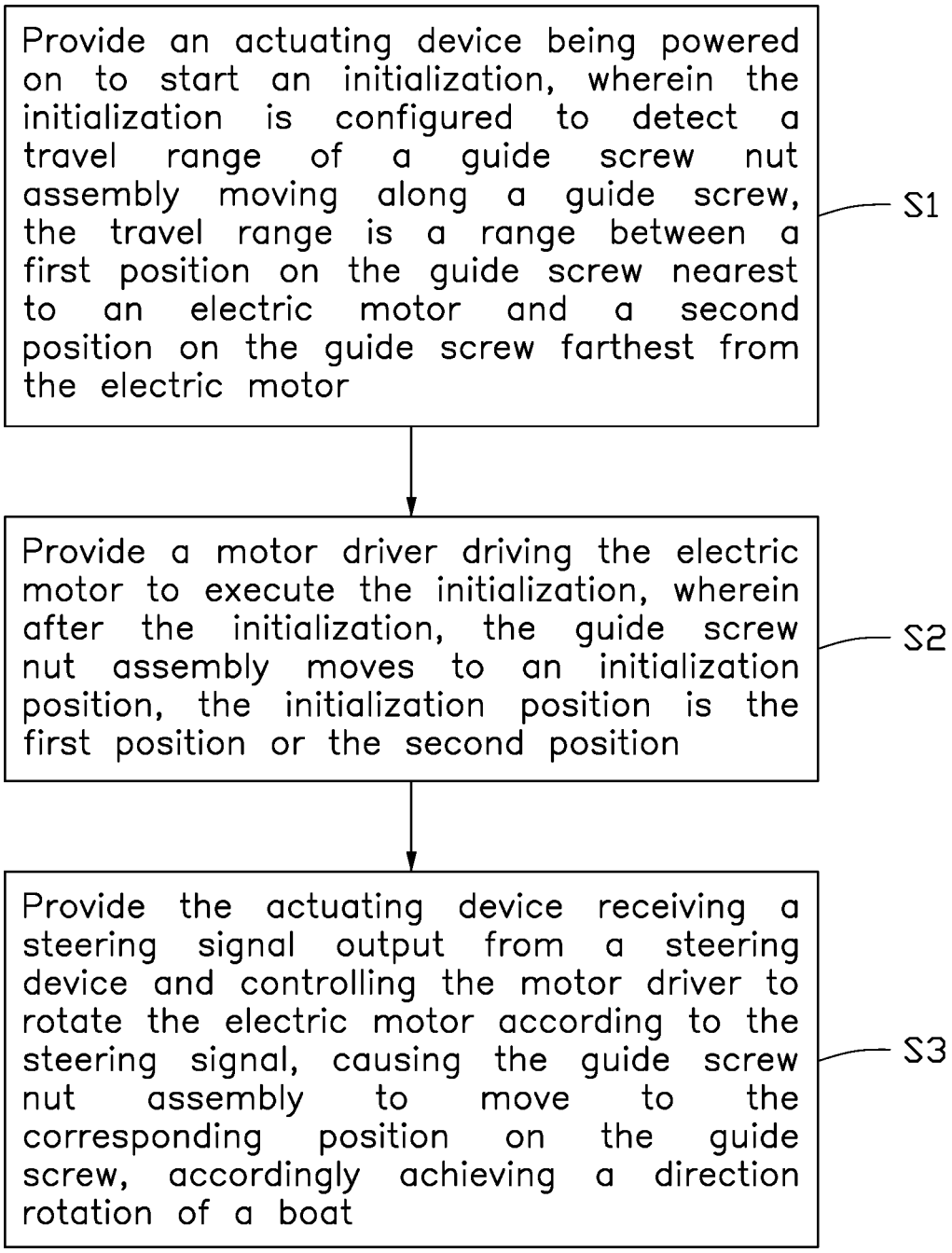
FIG. 14 is a flowchart of a method for controlling an electric steering system according to the present disclosure.

Referring to FIG. 14, a flowchart of a method for controlling the electric steering system. The method for controlling the electric steering system begins at block S1.

At block S1, provide an actuating device being powered on to start an initialization, wherein the initialization is configured to detect a travel range of a guide screw nut assembly moving along a guide screw, the travel range is a range between a first position on the guide screw nearest to an electric motor and a second position on the guide screw farthest from the electric motor. The guide screw nut assembly includes a guide screw nut and components moving together with the guide screw nut assembly, for example, a rod and a magnet.

At block S2, provide a motor driver driving the electric motor to execute the initialization, wherein after the initialization, the guide screw nut assembly moves to an initialization position, the initialization position is a reference position to calculate the rotation circles of the electric motor. Preferably, the initialization position is the first position or the second position, which is decided by a rotation sequence of the electric motor during the initialization. During the initialization, the guide screw nut assembly moves along the guide screw from left to right or from right to left to complete at least one round trip. When the guide screw nut assembly firstly moves toward the electric motor, and then moves away from the electric motor, the initialization is completed via stopping at the second position. Otherwise the initialization is completed via further returning to the first position.

At block S3, provide the actuating device receiving a steering signal output from a steering device and controlling the motor driver to rotate the electric motor according to the steering signal, causing the guide screw nut assembly to move to the corresponding position on the guide screw, accordingly achieving a direction rotation of a boat.

In one embodiment, the control method further includes block S4. At block S4, provide the steering device determining that the initialization is started and stopping sending the steering signal to the actuating device; and provide the steering device determining that the initialization is finished and resuming sending the steering signal to the actuating device.

In detail, provide the actuating device transmitting an initialization starting signal to the steering device, and provide the steering device stopping sending the steering signal; after the initialization, provide the actuating device transmitting a command of completing the initialization to the steering device, and provide the steering device determining that the initialization is completed according to the command and resumption of sending the steering signal.

Or, in detail, provide the steering device transmitting a command for starting initialization to the actuating device and stopping sending the steering signal; after the initialization, provide the actuating device transmitting a command of completing the initialization to the steering device, and provide the steering device determining that the initialization is completed according to the command of completing the initialization and resuming sending the steering signal.

In one embodiment, before S1, the control method further includes block S5. At block S5, provide the steering device being powered on to transmit a command for starting initialization to the actuating device, and provide the actuating device starting the initialization according to the command for starting initialization.

In other embodiments, before S1, the control method further includes block S5. At block S5, provide the actuating device being powered on to start the initialization.

In one embodiment, the control method further includes block S6. At block S6, provide the steering device being powered on and transmitting a command for frequency to the actuating device, provide the actuating device receiving the command for frequency and feedbacking a signal for frequency to the steering device, and provide the steering device establishing a communication connection with the actuating device according to the signal for frequency.

In other embodiments, the control method further includes block S6. At block S6, provide the actuating device being powered on and transmitting a command for frequency to the steering device, provide the steering device receiving the command for frequency and feeding back the signal for frequency to the actuating device, and provide the actuating device establishing a communication connection with the steering device according to the signal for frequency.

In one embodiment, the block S3 includes: provide a first controller calculating a theoretical rotation number according to the steering signal, reading the output signal from the first position sensor to obtain motor actual rotation number, and stopping rotating the electric motor after the motor actual rotation number reaches the theoretical rotation number.

In one embodiment, the control method further includes: provide a second controller reading the output signal from the second position sensor at preset frequency, calculating the steering signal according to the output signal, and transmitting the steering signal to the actuating device. The steering signal includes at least one angle value and an angle direction.

In one embodiment, start an initialization of the block S1 begins at block A1.

At block A1, provide the electric motor rotating to bring the guide screw to rotate, causing the guide screw nut assembly to move toward the electric motor along the guide screw.

At block A2, provide the position switch detecting that the guide screw nut assembly moves to the first position and accordingly transmitting the positioning signal to the first controller. Provide the first controller controlling the electric motor to stop rotating and recording the actual rotation number N1 of the electric motor at the moment.

At block A3, provide the electric motor rotating in a direction reverse to the direction in the block A1, causing the guide screw nut assembly to move away from the electric motor along the guide screw. Provide the position switch detecting that the guide screw nut assembly moves to the second position farthest from the electric motor. Provide the first controller accordingly controlling the electric motor to stop rotating and recording the actual rotation number N2 of the electric motor at the instant moment. The second position is the position that the actual rotation number of the electric motor reaches the limit and the actual rotation number of the electric motor is no more the theoretically maximal rotation number of the electric motor calculated according to a travel length of the guide screw and a movement rate on the guide screw.

At block A4, provide the first controller updating the mapping relationship between the rotation number of the electric motor and a travel range of the guide screw nut assembly moving along the guide screw according to N1 and N2, and saving the mapping relationship.

Block A4 includes: calculating an increase of the rotation number of the electric motor ΔN=N2−N1, controlling the maximal actual rotation number of the electric motor to be no more than ΔN, selecting N1 or N2 to be a reference rotation number of the electric motor to calculate an increase between a current rotation number of the electric motor and the reference rotation number of the electric motor, thereby obtaining a distance between the position of a current guide screw nut assembly and the initialization position.

In other embodiments, start an initialization of the block S1 begins at block A1.

At block A1, provide the electric motor rotating to bring the guide screw to rotate, causing the guide screw nut assembly to move toward the electric motor along the guide screw.

At block A2, provide the position switch detecting that the guide screw nut assembly moves to the first position and accordingly transmitting the positioning signal to the first controller. Provide the first controller controlling the electric motor to stop rotating and recording the actual rotation number N1 of the electric motor at the moment.

At block A3, provide the electric motor rotating in a direction reverse to the direction in block A1, causing the guide screw nut assembly to move away from the electric motor along the guide screw. Provide the position switch detecting that the guide screw nut assembly moves to the second position farthest from the electric motor. Provide the first controller accordingly controlling the electric motor to stop rotating and recording the actual rotation number N2 of the electric motor at the moment. The second position is the position that the actual rotation number of the electric motor reaches the limit and the actual rotation number of the electric motor is not more than a theoretically maximal rotation number of the electric motor calculated according to a travel length of the guide screw and a movement rate on the guide screw.

At block A4, provide the electric motor rotating in a direction reverse to the direction in the block A3, causing the guide screw nut assembly to move back to the first position from the second position. Provide the position switch transmitting the positioning signal to the first controller. Provide the first controller accordingly controlling the electric motor to stop rotating and recording the actual rotation number N3 of the electric motor at the moment.

At block A5, provide the first controller updating the mapping relationship between the rotation number of the electric motor and a travel range of the guide screw nut assembly moving along the guide screw according to N1, N2, and N3, and saving the mapping relationship.

Block A5 includes: calculating increases of the rotation number of the electric motor ΔN2=N2−N1, ΔN3=N3−N2, controlling the maximal actual rotation number of the electric motor to be no more than ΔN2 or ΔN3, selecting N1, or N2, or N3 to be a reference rotation number of the electric motor to calculate an increase between a current rotation number of the electric motor and the reference rotation number of the electric motor, thereby obtaining a distance between the position of a current guide screw nut assembly and the initialization position.

In one embodiment, in block A3, before the actual rotation number of the electric motor reaches the theoretically maximal rotation number, provide the first controller determining that the electric motor is stalled and modifying the theoretically maximal rotation number of the electric motor to be the actual rotation number of the electric motor when the electric motor is stalled. When the electric motor is running, the output signal from the second position sensor during a sample time, namely the actual rotation number of the electric motor during the sample time obtained by the first controller does not vary, provide the first controller determining that the electric motor is stalled.

In one embodiment, set a work mode of the steering device to be mode one or mode two according to an installed manner of the electric steering system, namely set a work mode of the steering device to be starboard mode or port mode.

Mode one: provide the steering device rotating clockwise, accordingly the boat rotates to starboard, provide the steering device rotating counterclockwise, accordingly the boat rotates to port; mode two: provide the steering device rotating clockwise, accordingly the boat rotates to port, provide the steering device rotating counterclockwise, accordingly the boat rotates to starboard.

In one embodiment, the rotation travel of the steering device and the increase of the rotation number of the electric motor have a first mapping relationship. The steering device at a clockwise limit position and at a counterclockwise limit position respectively correspond to that an increase of the rotation number of the electric motor is zero and maximum. The maximum increase of the rotation number of the electric motor is calculated according to a travel length of the guide screw and a movement rate on the guide screw After the initialization, establishing a second mapping relationship between the increase of the rotation number of the electric motor and the travel range of the guide screw nut assembly moving along a guide screw. Establishing a third mapping relationship between the rotation travel of the steering device and the travel range of the guide screw nut assembly, thus the steering device at a clockwise limit position or at a counterclockwise limit position respectively correspond to the guide screw nut assembly at the first position of the guide screw and at the second position of the guide screw, namely the rotation travel of the steering device and the travel range of the guide screw nut assembly have a one-to-one mapping relationship. Namely, the rotation angle of the steering device decides the theoretical number that the second controller controls the electric motor to rotate, the actual number that the electric motor rotates decides the position of the guide screw nut assembly on the guide screw, and the position of the guide screw nut assembly on the guide screw decides the orientation of the propeller, each form one-to-one mapping.

Before the initialization, the steering device and the increase of the rotation number of the electric motor have a mapping relationship. The initialization can determine the actual travel of the guide screw, namely a theoretical maximal increase of the rotation number of the electric motor, and the first position or the second position can be selected to be a reference position to calculate the increase of the rotation number of the electric motor.

After the initialization, the rotation number of the electric motor at the initialization position can be taken to be a reference to calculate the increase of rotation of the electric motor at any one position.

The mapping relationship between the position of the guide screw nut assembly and the orientation of the propeller is decided by a structure of the actuating device and the installation position of the actuating device at the ship propulsion apparatus. After the actuating device is installed, the mapping relationship can be decided. Thus, the one-to-one mapping relationship between the rotation angle of the steering device and the orientation of the propeller is established.

In one embodiment, when the electric steering system is firstly installed on the ship propulsion apparatus, a neutral position calibration to the steering device is performed. Before calibrating, the steering device and the actuating device have a default mapping relationship.

The angle position of the steering device includes: the clockwise limit position, the counterclockwise limit position, and a neutral position between the clockwise limit position and counterclockwise limit position.

The position of guide screw nut assembly on the guide screw includes: the first position, the second position, and a middle position between the first position and the second position (the third position).

The orientation of the propeller relative to the boat includes: the limit position of deflecting left, the limit position of deflecting right, and a position parallel and towards the orientation of the major axis of the boat, preferably, the position towards the straight backward position of the boat.

The position of the steering device and the position of the guide screw nut assembly have a one-to-one mapping relationship in the default mapping. The first position and the second position respectively correspond to the limit position of deflecting left of the propeller relative to the orientation of the boat and the limit position of deflecting right of the propeller relative to the orientation of the boat. The installation position of the actuating device is different when the actuating device is installed at different ship propulsion apparatuses. The third position of the guide screw may not correspond to the position of the propeller towards the straight backward position of the boat. During operation, whether a deviation is existed between the current orientation of the propeller and the straight backward position of the boat should be determined. Namely, whether the propeller can propel the boat to drive straight forward should be determined. The determination will be taken as a steering reference. When the electric steering system is firstly installed at the ship propulsion apparatus, the neutral position calibration to the steering device is performed. Thus, the guide screw nut assembly is at the third position of the guide screw when the steering device is at the neutral position, causing the propeller to be at the position to propel the boat to drive straight forward. Performing the neutral position calibration can begin at block B1.

At block B1, provide the electric steering system entering the calibration mode.

At block B2, provide the steering device rotating to the neutral position of the steering device, and provide the first controller recording the rotation number of the electric motor when the guide screw nut assembly moves from the initialization position to the current position.

At block B3, provide the steering device rotating continuously to cause the propeller of the ship propulsion apparatus to rotate to the position parallel and towards the orientation of the major axis of the boat with respect to the orientation of the boat. Provide the first controller calculating a variation value and a variation direction with respect to the rotation number of the electric motor in block B2. Provide the first controller using the variation value and the variation direction to be a compensation value to establish a new one-to-one mapping relationship between the rotation travel of the steering device and the travel range of the guide screw nut assembly moving along the guide screw.

At block B4, provide the electric steering system saving the new one-to-one mapping relationship and exiting the calibration mode.

In other embodiments, performing the neutral position calibration can begin at block C1.

At block C1, provide the electric steering system entering the calibration mode.

At block C2, provide the steering device rotating to the neutral position of the steering device, and provide the second controller recording the current angle position of the steering position.

At block C3, provide the steering device rotating continuously to cause the propeller of the ship propulsion apparatus to rotate to the position parallel and towards the orientation of the major axis of the boat with respect to the orientation of the boat. Provide the second controller calculating an angle variation value and an angle variation direction of the steering device with respect to the angle position in block C2. Provide the second controller using the angle variation value and the angle variation direction to be a compensation value to establish a new one-to-one mapping relationship between the rotation travel of the steering device and the travel range of the guide screw nut assembly moving along the guide screw.

At block C4, provide the electric steering system saving the new one-to-one mapping relationship and exiting the calibration mode.

Optionally, provide the steering device including a mechanical label to indicate that the steering wheel is rotated to the neutral position, or including an indicator light to indicate whether the steering device is rotated to the neutral position.

Optionally, provide a button of the steering device being pressed to trigger the first controller to read the signal from the first position sensor when the electric steering system enters the calibration mode. During the calibration, provide the first controller reading the signal from the first position sensor to calibrate, and not to control the direction. The steering wheel can be operated by the user to perform a normal control of the direction after exiting the calibration mode.

Optionally, provide the second control having two control modes to be automatically switched or manually switched between the two control modes. One control mode is a convention one-to-one mapping relationship. The other control mode is the mapping mode being automatically adjusted according to the speed detected by the GPS module. Namely, further establishing a one-to-one mapping relationship between the rotation angle of the steering device and the angle of the orientation of the propeller of the ship propulsion apparatus which is automatically adjusted according to the speed. At different speeds, the rotation speeds and the travels of the boat are different when the steering wheel rotates a same angle. Moreover, because of a limitation of the structure, different boats have a corresponding smallest turning radius, thus the boat may generate a big bump, even may be tipped over when the boat is not operated well. The automatically adjusting mapping mode can reduce the angle variation value during high speed moving of the boat, thus the driving can be steadier.

The control method causes the electric steering system to be adapted to different systems of the ship propulsion apparatus and simples an operation of the user. Moreover, the control method is simple and intuitive, and have a good user experience. When the electric steering system is firstly installed on the ship propulsion apparatus, a neutral position calibration to the steering device is performed, thus the steering device is at the neutral position, thus it is convenient for the user to taken as a steering reference.

It should be noted that, the above embodiments are merely to illustrate the technical solutions of the present disclosure, they are not intended to be limiting, although the preferred examples with reference to the present disclosure have been described in detail, a person skilled in the art will understand that the present disclosure may be modified or equivalents replaced, without departing from the spirit and scope of the present disclosure.

What is claimed is:

1. An electric steering system applicable on a ship propulsion apparatus, the ship propulsion apparatus comprising a link arm and a rotatable assembly, the rotatable assembly comprising a propeller, the link arm rotating to bring the rotatable assembly to rotate along an axis of the ship propulsion apparatus, thereby adjusting an orientation of the propeller, the electric steering system comprising:

a steering device configured to transmit a steering signal; and an actuating device rotatably coupled to an end of the link arm, the actuating device comprising an electric motor, a first controller, and a first position sensor, wherein the actuating device controls the electric motor to rotate the link arm according to the steering signal, the first controller controls a rotation direction and a rotation number of the electric motor according to the steering signal, and the first position sensor detects the rotation number of the electric motor and feedbacks the rotation number of the electric motor to the first controller to complete a closed-loop control.

2. The electric steering system according to claim 1, wherein:

the electric steering system further comprises a guide screw and a guide screw nut;

the guide screw is coupled to the electric motor;

the guide screw nut is coupled to the link arm; and the electric motor rotates the guide screw, causing the guide screw nut to move in a straight line along the guide screw, thereby rotating the link arm.

3. The electric steering system according to claim 2, wherein the electric motor is an outer rotor motor, the guide screw is coupled to a rotor of the outer rotor motor.

4. The electric steering system according to claim 2, wherein:

the actuating device further comprises a rod;

the rod is a hollow rod; and the guide screw nut is arranged in the rod and fixed to the link arm via the rod.

5. The electric steering system according to claim 2, wherein:

the actuating device further comprises a connector coupled between the electric motor and a steering tube of the ship propulsion apparatus; and the guide screw passes through the connector to be coupled to the electric motor.

6. The electric steering system according to claim 2, wherein an output shaft of the electric motor and the guide screw are coaxially arranged.

7. The electric steering system according to claim 1, wherein the actuating device further comprises a non-contact position switch, the non-contact position switch is electrically coupled to the first controller and is configured to output a switch signal to the first controller.

8. The electric steering system according to claim 1, wherein the actuating device comprises a first controller, a motor driver, the electric motor, a position switch, a guide screw, and a guide screw nut arranged in sequence from left to right, or comprises the electric motor, the motor driver, the first controller, the position switch, the guide screw, and the guide screw nut arranged in sequence from left to right.

9. The electric steering system according to claim 1, wherein:

the steering device comprises a steering wheel, a steering shaft, a steering base, a planetary gear sets, and a second position sensor;

a lower end of the steering shaft is rotatably inserted in the steering base;

the planetary gear sets and the second position sensor are arranged in the steering base;

an input end of the planetary gear sets is coupled to the steering shaft; and the second position sensor is configured to detect a rotation angle of an output end of the planetary gear sets.

10. The electric steering system according to claim 9, wherein:

the steering device further comprises a rotary damper;

the rotary damper is arranged in the steering base;

an inner ring of the rotary damper is fixed to the steering shaft; and an outer ring of the rotary damper is fixed to the steering base.

11. A ship propulsion apparatus comprising:

a link arm;

a rotatable assembly comprising a propeller;

a steering device configured to transmit a steering signal; and an actuating device comprising an electric motor, a first controller, and a first position sensor, wherein:

the actuating device is configured to control the electric motor to rotate the link arm according to the steering signal, bring the rotatable assembly to rotate along an axis of the ship propulsion apparatus, thereby adjusting an orientation of the propeller, the actuating device is rotatably coupled to a first end of the link arm, and the rotatable assembly is rotatably coupled to a second end of the link arm, the first controller controls a rotation direction and a rotation number of the electric motor according to the steering signal, and the first position sensor detects the rotation number of the electric motor and feedbacks the rotation number of the electric motor to the first controller to complete a closed-loop control.

12. A method for controlling an electric steering system applicable on the electric steering system, the electric steering system being applicable on the ship propulsion apparatus, the ship propulsion apparatus comprising a link arm and a rotatable assembly, the rotatable assembly comprising a propeller, the link arm rotating to bring the rotatable assembly to rotate along an axis of the ship propulsion apparatus, thereby adjusting an orientation of the propeller, the method comprising:

providing a steering device transmitting a steering signal;

providing an actuating device rotatably coupled to an end of the link arm, the actuating device comprising an electric motor and controlling the electric motor to rotate the link arm according to the steering signal;

determining by the steering device whether an initialization is started or finished;

providing the steering device to stop sending the steering signal to the actuating device if the provided steering device determines that the initialization is started; and providing the steering device to resume sending the steering signal to the actuating device if the provided steering device determines that the initialization is finished.

13. The method according to claim 12, wherein before providing the steering device transmitting the steering signal, the method further comprising:

providing an actuating device to be powered on to start the initialization, wherein the initialization is configured to detect a travel range of a guide screw nut assembly of the actuating device moving along a guide screw of the actuating device, the travel range is a range between a first position on the guide screw nearest to an electric motor of the actuating device and a second position on the guide screw farthest from the electric motor; and providing a motor driver of the actuating device driving the electric motor to execute the initialization, wherein after the initialization, the guide screw nut assembly moves to an initialization position, the initialization position is the first position or the second position.

14. The method according to claim 13, wherein executing the initialization comprises:

providing the electric motor to rotate to bring the guide screw to rotate, causing the guide screw nut assembly to move toward the electric motor along the guide screw;

providing a position switch of the actuating device to detect that the guide screw nut assembly moves to the first position and accordingly transmitting the positioning signal to a first controller of the actuating device to control the electric motor to stop rotating;

providing the first controller to record a first actual rotation number N1 of the electric motor;

providing the electric motor to rotate to bring the guide screw to rotate, causing the guide screw nut assembly to move away from the electric motor along the guide screw;

providing the position switch to detect that the guide screw nut assembly moves to the second position farthest from the electric motor to control the electric motor to stop rotating;

providing the first controller to record a second actual rotation number N2 of the electric motor, the second position being the position that the actual rotation number of the electric motor reaches limit and the actual rotation number of the electric motor is no more than a theoretically maximal rotation number of the electric motor calculated according to a travel length of the guide screw and a movement rate on the guide screw; and providing the first controller to update a mapping relationship between a rotation number of the electric motor and a travel range of the guide screw nut assembly moving along the guide screw according to the N1 and the N2.

15. The method according to claim 13, wherein before providing the actuating device to be powered on to start the initialization, the method further comprises:

providing a first controller of the actuating device to establish a mapping relationship between an increase of a rotation number of the electric motor and the travel range of the guide screw nut assembly on the guide screw;

providing the first controller to calculate an increase of a theoretically maximal rotation number of the electric motor according to a travel length of the guide screw and a movement rate on the guide screw;

providing a second controller of the steering device to establish a relationship that a clockwise limit position corresponds to an increase of the rotation number of the electric motor being zero;

providing the second controller to establish a relationship that a counterclockwise limit position corresponds to an increase of the theoretically maximal rotation number of the electric motor;

providing the second controller to establish a mapping relationship between a rotation travel of the steering device and the increase of the rotation number of the electric motor according to the relationship that the clockwise limit position corresponds to an increase of the rotation number of the electric motor being zero and the relationship that the counterclockwise limit position corresponds to an increase of the theoretically maximal rotation number of the electric motor; and providing the second controller to establish a mapping relationship between the rotation travel of the steering device and the travel range of the guide screw nut assembly moving along the guide screw according to the mapping relationship between an increase of the rotation number of the electric motor and the travel range of the guide screw nut assembly moving along the guide screw and the mapping relationship between a rotation travel of the steering device and the increase of the rotation number of the electric motor.

16. The method according to claim 12, wherein before providing the steering device transmitting the steering signal, the method further comprises:

providing the electric steering system to enter a calibration mode;

providing the steering device to rotate to a neutral position of the steering device;

providing a first controller of the actuating device to record a first rotation number of the electric motor when a guide screw nut assembly moves from an initialization position to a current position when the steering device is rotated to the neutral position of the steering device;

providing the steering device rotating continuously to cause the propeller of the ship propulsion apparatus to rotate to a propeller position parallel and towards an orientation of a major axis of a boat with respect to an orientation of the boat;

providing the first controller to calculate a variation value and a variation direction between a second rotation number of the electric motor when the propeller of the ship propulsion apparatus is rotated to the propeller position and the first rotation number of the electric motor; and providing the first controller to use the variation value and the variation direction to be a compensation value to establish a new one-to-one mapping relationship between rotation travel of the steering device and travel range of the guide screw nut assembly moving along the guide screw.

17. The method according to claim 12, wherein before providing the steering device transmitting the steering signal, the method further comprises:

providing the electric steering system to enter a calibration mode;

providing the steering device to rotate to a neutral position of the steering device;

providing a second controller of the steering device to record a first angle position of the steering device when the steering device is rotated to the neutral position of the steering device;

providing the steering device to rotate continuously to cause the propeller of the ship propulsion apparatus to rotate to a second angle position parallel and towards an orientation of a major axis of a boat with respect to an orientation of the boat;

providing the second controller to calculate a variation value and a variation direction between a second angle position and the first angle position; and providing the second controller to use the variation value and the variation direction to be a compensation value to establish a new one-to-one mapping relationship between rotation travel of the steering device and travel range of a guide screw nut assembly moving along the guide screw.

18. The method according to claim 12, further comprising:

providing a second controller of the steering device to establish a mapping relationship between a rotation angle of the steering device and an angle of an orientation of the propeller of the ship propulsion apparatus.

* * * * *